US005434655A

United States Patent [19]

Okamura

[11] Patent Number: 5,434,655

[45] Date of Patent: Jul. 18, 1995

[54] PRINTER WITH IMPROVED TONER LOADER DOOR

[75] Inventor: Mike H. Okamura, Boise, Id.

[73] Assignee: Hewlett-Packard Company, Palo Alto, Calif.

[21] Appl. No.: 300,008

[22] Filed: Sep. 2, 1994

[51] Int. Cl.[6] ..... G03G 15/06

[52] U.S. Cl. ..... 355/260; 141/319; 141/375; 222/DIG. 1

[58] Field of Search ..... 355/245, 260; 222/DIG. 1; 141/284, 319, 369, 375, 383

[56] References Cited

U.S. PATENT DOCUMENTS 4,489,765 12/1984 Yamada et al. ..... 141/319 X
5,200,781 4/1993 Hata ..... 355/245 X

FOREIGN PATENT DOCUMENTS 4-145469 5/1992 Japan ..... 355/260

*Primary Examiner*—William J. Royer

[57] ABSTRACT

A laser printer includes a cover with a top surface and an adjoining wall having an inlet opening for single-fed sheets. A receptacle is positioned beneath the cover for receiving a toner supply and is positioned adjacent the adjoining wall. A toner loader door encloses the receptacle and includes a first portion which mates with the cover's top surface and a second portion that abuts the adjoining wall. The first and second portions meet at point of joinder to form an L-shape. The second portion of the toner loader door is pivotally mounted to the adjoining wall and enables the toner loader door to pivot between an open position and a closed position. A sheet feed mechanism is positioned adjacent the wall and feeds sheets through the inlet opening. The sheet feed mechanism is pivotally mounted to the printer by a spring biased pivot which forces the sheet feed mechanism against the toner loader door so as to maintain it in a closed position. The sheet feed mechanism is hand pivotable away from the wall to allow the cover to be pivoted to the open position, where the point of joinder and the sheet feed mechanism interact to maintain the toner loader door in the open position.

5 Claims, 2 Drawing Sheets

PRINTER WITH IMPROVED TONER LOADER DOOR

FIELD OF THE INVENTION

This invention relates to electrophotographic printer structures and, more particularly, to an improved toner loader door for such a structure.

BACKGROUND OF THE INVENTION

Presently, high performance laser printers employ replaceable toner cartridges. Such toner cartridges include not only a replacement toner supply but also include mechanisms that are subject to wear during the operation of the printer and are replaced each time a new toner cartridge is substituted for an exhausted cartridge. While such mechanisms assure a printer's continuing performance, they are expensive and add significantly to the operating cost of a laser printer.

In order to reduce the cost of laser printers, newer designs employ re-chargeable toner reservoirs that are contained within the printer. This is especially true in color laser printers wherein four separate toner reservoirs are required. Such toner reservoirs are maintained within the covers of the printer and are accessible when a toner loader door is opened. At such time, a toner bottle is mated with a toner reservoir and toner is dumped into the reservoir to replenish its supply. During the replenishment operation, two hands are required, one to hold the toner bottle and another to remove a seal from the mouth of the toner bottle so as to enable it to communicate with the toner reservoir. As a result, the toner loader door must maintain itself in an open position without requiring any hand interaction from the user.

While many mechanisms are available to maintain a toner loader door in both open and closed conditions, such mechanisms add to the expense of the printer structure and are to be avoided, if possible.

Accordingly, it is an object of this invention to provide a laser printer with an improved toner loader door arrangement.

It is another object of this invention to provide an improved toner loader door mechanism wherein the toner loader door maintains itself in both open and closed positions without a requirement for additional closure and opening mechanisms.

SUMMARY OF THE INVENTION

A laser printer includes a cover with a top surface and an adjoining wall having an inlet opening for single-fed sheets. A receptacle is positioned beneath the cover for receiving a toner supply and is positioned adjacent the adjoining wall. A toner loader door encloses the receptacle and includes the first portion which mates with the cover's top surface and a second portion that abuts the adjoining wall. The first and second portions meet at point of joinder to form an L-shape. The second portion of the toner loader door is pivotally mounted to the adjoining wall and enables the toner loader door to pivot between an open position and a closed position. A sheet feed mechanism is positioned adjacent the wall and feeds sheets through the inlet opening. The sheet feed mechanism is pivotally mounted to the printer by a spring biased pivot which forces the sheet feed mechanism against the toner loader door so as to maintain it in a closed position. The sheet feed mechanism is hand pivotable away from the wall to allow the cover to be pivoted to the open position, where the point of joinder and the sheet feed mechanism interact to maintain the toner loader door in the open position.

DETAILED DESCRIPTION OF THE INVENTION

Figure 1:
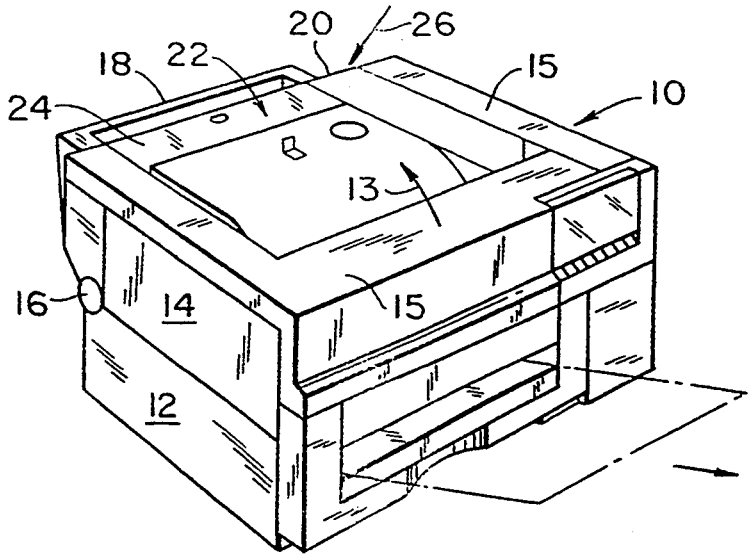
FIG. 1 is a perspective view of a laser printer that incorporates the invention hereof.

Referring to FIG. 1, a laser printer 10 includes a lower cover portion 12 and an upper cover portion 14. Upper cover portion 14 includes a top surface 15, is mounted about a pivot axis 16, and is rotatable away from lower cover portion 12 (in the direction of arrow 13) so as to expose inner working portions of printer 10. Mounted on the rear wall of upper cover portion 14 is a single sheet feed mechanism 18 which is also mounted on pivot axis 16. Thus, when upper cover portion 14 is rotated about pivot axis 16 in the direction of arrow 13, single sheet feed mechanism 18 is also caused to rotate in the same counterclockwise direction. Single sheet feed mechanism 18 is also independently movable about pivot 16 from upper cover portion 14. While not expressly shown, single sheet feed mechanism 18 is spring biased about pivot axis 16 to bear against rear wall 20 and a toner loader door 22 (seen in FIG. 1 in its closed position).

Figure 2:
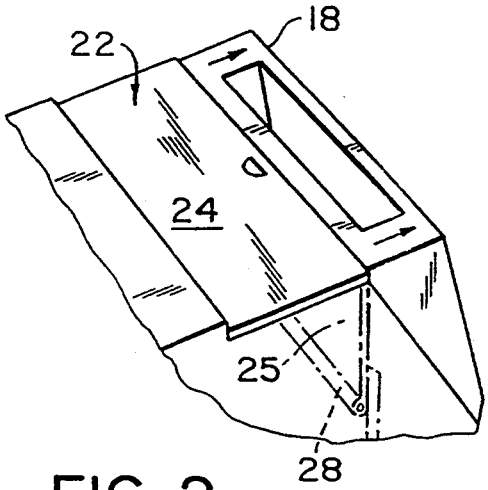
FIG. 2 is a perspective view of the rear wall of the printer mechanism of FIG. 1 showing both an uppermost aspect of a toner loader door and a single sheet feed mechanism.

In FIG. 2, a perspective view of toner loader door 22 and sheet feed mechanism 18 is shown as seen from the vantage point indicated by arrow 26 in FIG. 1. Horizontal section 24 of toner loader door 22 is connected to a vertical section 25 that is shown in phantom. Vertical section 25 is pivotally mounted on a pivot arm 28 and is movable thereabout in both clockwise and counterclockwise directions.

Figure 3:
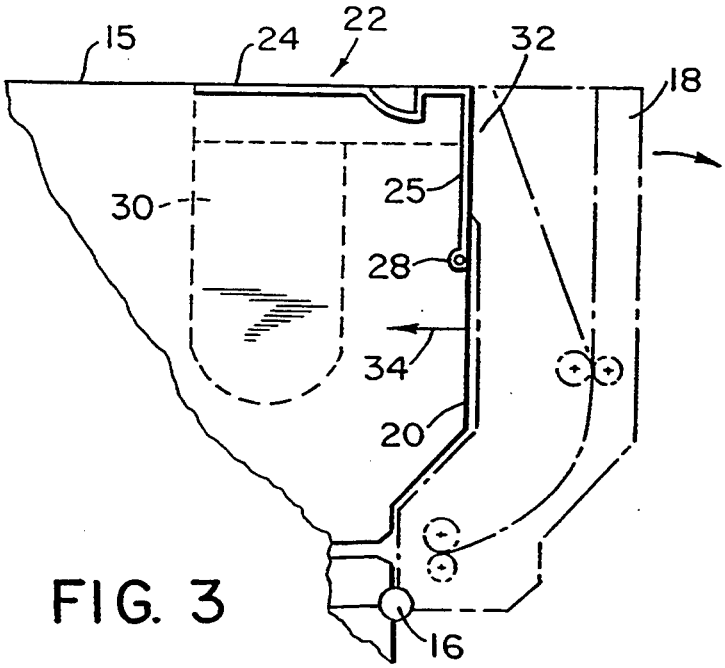
FIG. 3 is a schematic side view of the sheet feed mechanism and the toner loader door when the toner loader door is in a closed position.

Referring to FIG. 3, a schematic side view is shown of toner loader door 22 and sheet feed mechanism 18. Toner loader door 22, in its closed position, maintains a plurality of toner reservoirs 30 in a covered state. The spring force exerted about pivot axis 16 causes extended portion 32 of sheet feed mechanism 18 to bear upon vertical section 25 of toner loader door 22. This action maintains toner loader door 22 in a closed position. Arrow 34 indicates the direction of force exerted by the spring mechanism about pivot axis 16.

Figure 4:
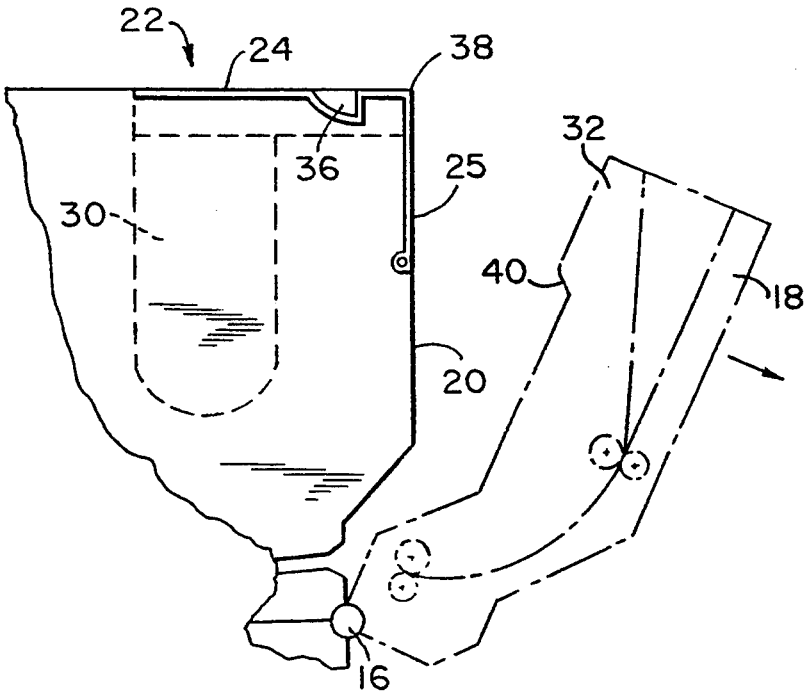
FIG. 4 is the schematic side view of FIG. 3 wherein the sheet feed mechanism has been pivoted away from engagement with the toner loader door.
Figure 5:
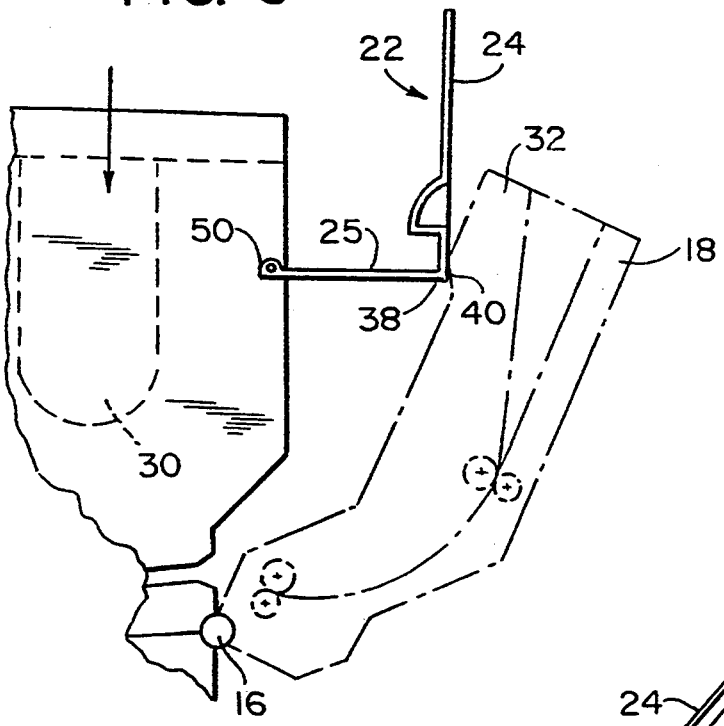
FIG. 5 is the schematic side view of FIG. 4 wherein the toner loader door has been opened and is in engagement with the sheet feed mechanism.

As shown in FIG. 4, when toner loader door 22 is to be opened, the user pivots sheet feed mechanism 18 in a clockwise direction against the spring force exerted by pivot axis 16. This disengages extended portion 32 from vertical section 25 of toner loader door 22. While maintaining sheet feed mechanism in the position, the user places a finger in indentation 36 and pivots toner loader door 22 in a clockwise direction. This causes the point of joinder 38 between horizontal section 24 and vertical section 25 of toner loader door 22 to pivot 90° in a clockwise direction and to engage a slanted terminus 40 of extended portion 32. This action is illustrated in FIG. 5.

Figure 6:
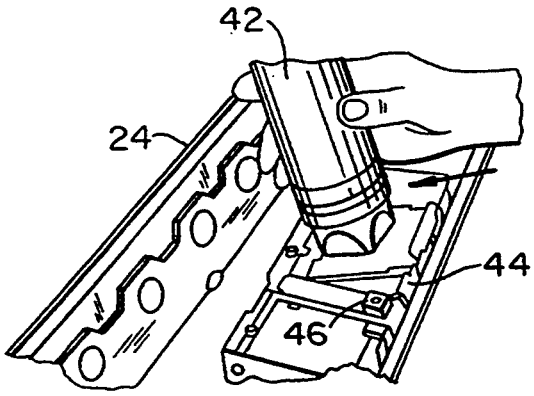
FIG. 6 is a perspective view showing a top view of the toner reservoirs when the toner loader door has been opened and a toner bottle is being emplaced over a toner reservoir.

Because of the spring force exerted by pivot axis 16 on sheet feed mechanism 18, slanted terminus 40 of extended portion 32 bears against point of joinder 38 and maintains toner loader door 22 in a stable, open position. Because of this interaction, the user is free to use both hands to replenish a toner reservoir 30 by insertion of a toner bottle into communication therewith. Such action is shown in FIG. 6.

A user inserts a toner bottle 42 into a holding mechanism 44. Once toner bottle 42 is engaged with holding mechanism 44, a slide 46 is operated by the user's other hand to both open a door into a toner reservoir positioned therebeneath, while at the same time removing a seal from the lowermost portion of toner bottle 42.

At the conclusion of the toner loading operation (see FIG. 5), the user, having both hands available, pushes sheet feed mechanism 18 in a clockwise direction which causes the release of toner loader door 22. At such time, toner loader door 22 can be rotated in a counterclockwise direction to a closed position.

As a result of this design, toner loader door 22 need only be mounted on a pivot axis 50 and requires no spring closure mechanism or latch to maintain it in a closed position. As will be recalled, toner loader door 22 is maintained in its closed position by the action of extended portion 32 of sheet feed mechanism 18.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. Apparatus for emplacing images on sheets employing a toner supply, said apparatus comprising:

an apparatus cover for said apparatus including a top surface and an adjoining wall;

a receptacle for receiving a toner supply, said receptacle positioned beneath said top surface and juxtaposed to said wall;

a toner door for enclosing said receptacle and including a first section which coacts with said top surface and a second section that abuts said wall, said first and second sections joined at a point of joinder to form an L-shape, an extremity of said second section that is distant from said point of joinder pivotally mounted to said wall so as to enable said toner door to pivot between an open position and a closed position; and a sheet feed mechanism positioned adjacent said wall and pivotally mounted to said apparatus by spring pivot means, said spring pivot means forcing a surface of said sheet feed mechanism against said toner door to maintain said toner door in said closed position, said sheet feed mechanism hand pivotable away from said wall to allow said toner door to be pivoted to said open position, said point of joinder and sheet feed mechanism interacting to maintain said door in said open position.

2. The apparatus as recited in claim 1 wherein said sheet feed mechanism is biased against said second section of said toner door by said spring pivot means.

3. The apparatus as recited in claim 2, wherein said sheet feed mechanism includes an extended portion which bears against said second section of said toner door, said extended portion positioned only partially along a surface of said sheet feed mechanism, and including a terminating edge that engages said point of joinder of said first and second sections of said toner door when said toner door is in the open position.

4. The apparatus as recited in claim 3, wherein said toner door open position is 90° degrees displaced from said toner door closed position.

5. The apparatus as recited in claim 2, wherein said sheet feed mechanism is the sole means for maintaining the toner door in said closed position.

* * * * *